US010879647B2

(12) United States Patent
Brungard

(10) Patent No.: US 10,879,647 B2
(45) Date of Patent: Dec. 29, 2020

(54) DOUBLE POLE POWER CONNECTOR

(71) Applicant: FCI USA LLC, Etters, PA (US)

(72) Inventor: Thomas A. Brungard, York, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 16/354,518

(22) Filed: Mar. 15, 2019

(65) Prior Publication Data

US 2019/0288450 A1 Sep. 19, 2019

Related U.S. Application Data

(60) Provisional application No. 62/644,271, filed on Mar. 16, 2018.

(51) Int. Cl.

| | |
|---|---|
| ***H01R 24/00*** | (2011.01) |
| ***H01R 13/631*** | (2006.01) |
| ***H01R 12/70*** | (2011.01) |
| ***H01R 43/26*** | (2006.01) |
| ***H01R 13/502*** | (2006.01) |
| ***H01R 13/24*** | (2006.01) |

(52) U.S. Cl.

CPC ..... *H01R 13/631* (2013.01); *H01R 12/7088* (2013.01); *H01R 13/24* (2013.01); *H01R 13/502* (2013.01); *H01R 43/26* (2013.01)

(58) Field of Classification Search

CPC .... H01R 13/631; H01R 13/24; H01R 13/502; H01R 43/26; H01R 12/7088; H01R 13/2492

USPC ..... 439/76.1

See application file for complete search history.

(56) References Cited

U.S. PATENT DOCUMENTS

| | | | | |
|---|---|---|---|---|
| 6,848,950 | B2 * | 2/2005 | Allison | H01R 12/75 439/682 |
| 8,057,266 | B1 * | 11/2011 | Roitberg | H01R 13/055 439/682 |
| 8,388,389 | B2 * | 3/2013 | Costello | H01R 13/18 439/637 |
| 8,641,432 | B2 * | 2/2014 | Northey | G09B 19/00 439/110 |
| 9,153,887 | B2 * | 10/2015 | Chen | H01R 12/7088 |
| 9,419,356 | B2 | 8/2016 | Copper et al. | |
| 9,627,790 | B2 | 4/2017 | Anderson et al. | |
| 9,680,236 | B2 | 6/2017 | Ngo | |

(Continued)

FOREIGN PATENT DOCUMENTS

| | | |
|---|---|---|
| DE | 91 07 627 U1 | 8/1991 |
| WO | WO 93/15532 A1 | 8/1993 |

OTHER PUBLICATIONS

Extended European Search Report for European Application No. 14775056.6 dated Jan. 18, 2017.

(Continued)

*Primary Examiner* — Abdullah A Riyami
*Assistant Examiner* — Nelson R. Burgos-Guntin
(74) *Attorney, Agent, or Firm* — Wolf, Greenfield & Sacks, P.C.

(57) ABSTRACT

A power connector that provides a large tolerance for mating to a busbar. The connector has compliant mating contacts supported by a pivoting member. Upon insertion between two busbars, the compliant mating contacts compensate for a first amount of misalignment between the connector and the busbars. The contacts may pivot, compensating for an additional amount of misalignment.

23 Claims, 10 Drawing Sheets

(56) References Cited

U.S. PATENT DOCUMENTS

| | | | | |
|---|---|---|---|---|
| 10,050,395 | B2 | 8/2018 | Ngo et al. | |
| 10,424,887 | B2 * | 9/2019 | Hirschman | H01R 12/7088 |
| 2008/0299838 | A1 * | 12/2008 | Kopp | H01R 4/304 439/786 |
| 2009/0047814 | A1 * | 2/2009 | Daamen | H01R 13/6315 439/251 |
| 2009/0142953 | A1 | 6/2009 | Patel et al. | |
| 2011/0187348 | A1 * | 8/2011 | Soneda | H01R 25/003 324/117 H |
| 2015/0009607 | A1 * | 1/2015 | Daamen | H01R 27/02 361/640 |
| 2015/0364878 | A1 * | 12/2015 | Orris | H01R 24/20 439/55 |
| 2017/0036563 | A1 * | 2/2017 | Degner | B60L 15/04 |
| 2017/1491517 | | 5/2017 | Anderson et al. | |
| 2018/0006414 | A1 * | 1/2018 | Ooishi | H01R 25/162 |
| 2018/0145463 | A1 * | 5/2018 | Kiyuna | B60K 6/22 |
| 2019/0036422 | A1 * | 1/2019 | Shirai | H02K 11/21 |
| 2019/0123334 | A1 * | 4/2019 | Kataoka | H01M 2/206 |
| 2019/0239379 | A1 * | 8/2019 | Smith | G06F 1/26 |
| 2019/0288450 | A1 * | 9/2019 | Brungard | H01R 13/502 |
| 2019/0288461 | A1 * | 9/2019 | Kiyuna | H01R 13/405 |

OTHER PUBLICATIONS

Partial Supplementary European Search Report for European Application No. 14775056.6 dated Sep. 26, 2016.
U.S. Appl. No. 14/761,486, filed Jul. 16, 2015, Copper et al.
U.S. Appl. No. 29/687,528, filed Apr. 12, 2019, Wei et al.
EP 14775056.6, Sep. 26, 2016, Partial Supplementary European Search Report.
EP 14775056.6, Jan. 18, 2017, Extended European Search Report.

* cited by examiner

DOUBLE POLE POWER CONNECTOR

CROSS REFERENCE TO RELATED APPLICATIONS

This patent application claims priority to and the benefit of U.S. Provisional Patent Application Ser. No. 62/644,271, filed Mar. 16, 2018 and entitled "DOUBLE POLE POWER CONNECTOR," which is hereby incorporated herein by reference in its entirety.

BACKGROUND

This application relates generally to electrical interconnection system, such as those including electrical connectors, used to interconnect electronic assemblies.

Electrical connectors are used in many electronic systems. It is generally easier and more cost effective to manufacture a system as separate electronic assemblies, such as printed circuit boards ("PCBs"), which may be joined together with electrical connectors. A known arrangement for joining several PCBs is to have one PCB serve as a backplane. Other PCBs, called "daughterboards" or "daughtercards", may be connected through the backplane.

There are various types of electrical connectors associated with joining multiple sub-assemblies. For example, signal connectors transmit operating signals between PCBs; power connectors transmit electrical energy between PCBs and/or busbars; and combo connectors transmit in one connector both operating signals and electrical energy.

Frequently, the components of an electronic system are manufactured in different locations, often by different companies, and then assembled into a finished product. One company, for example may manufacture a "rack" or other support structure for all of the components. Another company may manufacture a backplane, which may be fitted with busbars and signal connectors. Yet other companies may manufacture daughtercards that are inserted on rails in the rack such that signal and power connectors on the daughtercards establish electrical connections with the signal connectors and busbars on the backplane.

For the entire system to function as intended when the components are assembled, the components must be made precisely enough that all of the components mechanically fit together and make electrical connection as intended. Components are designed with nominal positions but are also designed such that the system will still operate if components are out of their nominal positions by an acceptable amount, called a "tolerance." For example, mating contacts in one connector may be wider than needed when both connectors are in their nominal positions such that those contacts engage mating contacts even if one or both of the connectors are out of their nominal positions by less than the "tolerance" for misalignment of the connectors. Likewise, mating contacts in one connector may be made with compliant beams or similar structures that will yield if a mating contact from a mating connector is closer than when in its nominal position or will spring out to make contact with the mating contact from the mating connector that is further than when in its nominal position.

As electronic systems have gotten smaller and more complex, more connections are required in a smaller volume. As a result, less deviation in the positioning of signal and ground conductors is tolerable and tighter tolerances have generally been required. However, making components to meet tighter tolerances is more expensive than making components with more lenient tolerances.

BRIEF SUMMARY

Aspects of the present disclosure relate to improved interconnection systems, particularly portions of the interconnection system that supply power from busbars to electronic components on printed circuit boards.

Some embodiments relate to an electrical connector. The electrical connector may comprises an insulative housing, an insulative member pivotably mounted to the housing, and a first conductive element. The first conductive element may comprise a body and a mating portion, extending from the body. The body may be supported by the housing and the mating portion may be coupled to the insulative member pivotably mounted to the housing such that the mating portion pivots with the insulative member.

In some embodiments, the mating portion of the first conductive element may comprise a plurality of beams, and each of the plurality of beams may comprise a convex surface facing away from the insulative member.

In some embodiments, the mating portion of the first conductive element may comprise a plurality of beams, and the plurality of beams may be configured to carry in excess of 350 A with a temperature rise of no greater than 30° C.

In some embodiments, a frontend of the member may comprise a plurality of holes, and a distal end of each beam of the plurality of beams may be disposed within a hole of the plurality of holes.

In some embodiments, the housing may comprise a ceiling and a pair of walls that may extend from the ceiling. The pair of walls may be separated from each other by a wall-to-wall distance. The wall-to-wall distance may be greater than a width of the member.

In some embodiments, the housing may comprise a center piece between the pair of walls, a first slot between the center piece and a first wall of the pair of walls and a second slot between the center piece and a first wall of the pair of walls. A portion of the first conductive element may be disposed within the first slot. A portion of the second conductive element may be disposed within the second slot. The center piece may comprise an opening. A portion of the member may be disposed within the opening.

In some embodiments, the opening of the center piece may be semi-cylindrical and the portion of the member may be semi-cylindrical such that the member may be pivotable with respect to center piece.

In some embodiments, the electrical connector may further comprise a bushing inserted in the housing. A portion of the member may be pivotally retained within the bushing.

Some embodiments relate to an electrical connector. The electrical connector may comprise a housing, a member pivotably mounted to the housing, a pair of conductive elements. Each of the pair of conductive elements may comprise a mating end and a mounting end opposite the mating end, and an intermediate portion in the housing, the intermediate portion connecting the mating end and the mounting end. Mating ends of the conductive elements of the pair of conductive elements may be separated by the member.

In some embodiments, the mounting ends of the pair of conductive elements may be spaced from each other substantially by a first distance. The mating ends of the pair of conductive elements may be spaced from each other substantially by a second distance. The first distance may be greater than the second distance.

In some embodiments, the intermediate portion of each of the pair of conductive elements may comprise a first part, a second part, and a transition part that extends between the first and second part. The first parts of the pair of conductive elements may be spaced from each other substantially by the first distance. The second parts of the pair of conductive elements may be spaced from each other substantially by the second distance.

In some embodiments, the member may comprise a frontend, a backend, and a body that extends between the frontend and the anchor. The backend may be pivotably coupled to the housing such that the member may pivot with respect to the housing about an axis through the backend.

In some embodiments, the backend may be semi-cylindrical.

In some embodiments, the body of the member may comprise a first surface and a second surface, opposite the first surface. The first surface may comprise a first projection and the second surface may comprise a second projection. The mating end of a first conductive element of the pair of conductive elements may comprise a first opening receiving the first projection so as to hold the first conductive element adjacent the first surface. The mating end of a second conductive element of the pair of conductive elements may comprise a second opening receiving the second projection so as to hold the second conductive element adjacent the second surface.

In some embodiments, the frontend of the member may have a second width. The second width may be greater than the first width.

In some embodiments, the mating ends of the conductive elements of the pair of conductive elements may comprise a plurality of beams. The frontend of the member may comprise a first plurality of holes adjacent the first surface and a second plurality of holes adjacent the second surface. Distal tips of the plurality of beams of the first conductive element may be disposed within the first plurality of holes and distal tips of the plurality of beams of the second conductive element may be disposed within the second plurality of holes.

In some embodiments, the pair of conductive elements and the member may have complementary features such that the pair of conductive elements may be attached to opposite sides of the member.

Some embodiments relate to an electronic system. An electronic system my comprise a printed circuit board, first and second busbars elongated in parallel, and a connector. The first busbar may have a first surface facing a second surface of the second busbar. The connector may comprise a housing, a pivotable member pivotably mounted to the housing, and first and second conductive elements each comprising a mating end, a mounting end opposite the mating end, and an intermediate portion, the intermediate portion connecting the mating end and the mounting end. The mounting ends of the first and second conductive elements may be coupled to the printed circuit board. The mating ends of the first and second conductive elements may be attached to the pivotable member and inserted between the first and second busbars so as to establish electrical connections to the first and second surfaces.

In some embodiments, the mating ends of the of the first and second conductive elements may be spring biased against the first and second surfaces.

Some embodiments relate to a method of operating a connector mounted to a printed circuit board to make a connection to first and second parallel busbars. The first busbar may have a first surface facing a second surface of the second busbar. The connector may comprise a housing, first and second conductive elements comprising mating ends and portions held by the housing. The method may comprises positioning the printed circuit board with respect to the busbars such that a portion of the connector may be between the busbars, pushing the printed circuit board toward the busbars, thereby pivoting the mating ends with respect to the connector housing such that the mating ends may fit between first and second busbars and establish an electrical connection between the mating ends of the conductive element and the first and second surfaces.

In some embodiments, the portions of the first and second conductive elements attached to the housing may be parallel to an axis of elongation of the first and second busbars. The connector may have a first centerline midway between the portion of the first conductive elements attached to the housing and the portion of the second conductive elements attached to the housing. The busbars may have a second centerline midway between the first busbar and the second busbar. The first centerline may be offset from the second centerline in a direction perpendicular to the axis of elongation when an electrical connection between the mating ends of the conductive element and the first and second surfaces is established.

In some embodiments, the portions of the first and second conductive elements attached to the housing may be separated by a first distance. The first centerline may be offset from the second centerline by a distance exceeding 5% of the first distance.

In some embodiments, the first centerline may be offset from the second centerline by a distance exceeding 10% of the first distance.

The foregoing is a non-limiting summary of the invention, which is defined by the attached claims.

BRIEF DESCRIPTION OF DRAWINGS

In the drawings, each identical or nearly identical component that is illustrated in various figures is represented by a like numeral. For purposes of clarity, not every component may be labeled in every drawing. The accompanying drawings are not necessarily drawn to scale, with emphasis instead being placed on illustrating various aspects of the techniques and devices described herein.

DETAILED DESCRIPTION

The inventors have recognized and appreciated electrical connector designs to enable electronic systems that are smaller, faster, and functionally more complex. The inventors recognized that such systems may be enabled by power connectors that allow for a low resistance electrical contact between a power connector and busbars even with greater misalignment between the connector and the busbars. For example, a connector may have two poles to connect to a pair of busbars despite components of the position being out of alignment with respect to each other or their nominal positions. The inventors have also recognized and appreciated that connectors mating with a pair of busbars may be subject to various types of misalignments including, for example, a misaligned busbar, busbar-to-busbar misalignment, and a misalignment between a printed circuit board and the pair of busbars. The inventors have recognized and appreciated connector designs that can meet the need for a connector allowing for greater misalignment in a direction perpendicular to an elongated axis of the busbars while providing contact float to enable the connector to engage the busbars at any location along the elongated axis of the busbars. The connector may be able to tolerate misalignment up to 2 mm, in some embodiments, up to 1 mm, or up to 0.6 mm, for example. Further, the connector may be able to carry relatively large amounts of current, such as up to 1600 amps, or up to 800 amps, or up to 400 amps.

In accordance with some embodiments, an electronic system may be provided. In some embodiments, the electronic system may be data processing equipment, or telecommunication equipment, or data communication/networking equipment (e.g., a server, switch, or storage device) that require AC and/or DC pluggable power supplies. In some embodiments, the electronic system may be rack mounted or may distribute power using busbar-to-busbar connection. In some embodiments, the electronic system may be an industrial equipment requiring high current density connections between busbars and PCBs. In some embodiments, the system may be hyperscale computing architectures using busbars for power distribution. In some embodiments, the electronic system may utilize connectors to distribute power within the system, for example, from busbars to PCBs, or from busbars to busbars.

In some embodiments, a connector may be provided. The connector may be used in the above-mentioned electronic systems to distribute power. The connector may include a member pivotably mounted to a housing such that the member can pivot to fit between a pair of busbars, which may be misaligned with respect to each other or with respect to a PCB to which the connector is attached.

Figure 1A:
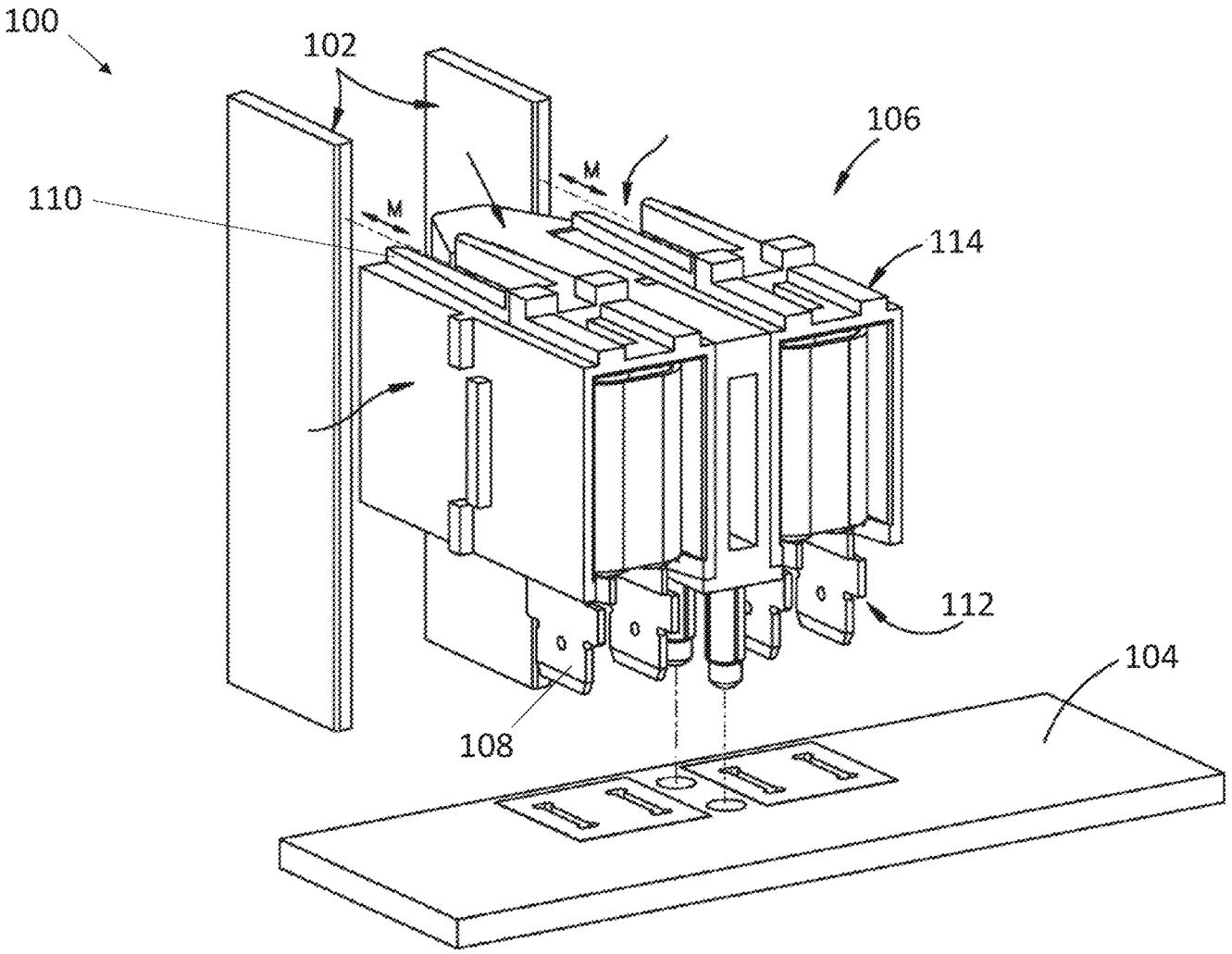
FIG. 1A (PRIOR ART)
FIG. 1A is a perspective view of a power interconnect of an electronic system, with a power connector mounted to a printed circuit board.

FIG. 1A illustrates an electronic system 100 of conventional design. A pair of busbars 102 is shown, but the system may include any suitable number of busbars. The pair or busbars may carry any suitable voltage or voltages such as two different supply voltages, a supply voltage and a return or the same voltage so that current carrying capacity is doubled relative to the capacity of single busbar.

In the embodiment illustrated, the busbars have axes of elongation in a vertical direction. Such a configuration may be used, for example, in an electronic rack in which the busbars run along the back of the rack. FIG. 1A also illustrates a printed circuit board 104, which may contain circuitry, such as processors, memory or transceivers, such as in a conventional daughtercard that may be inserted into the front of a rack. The printed circuit board is connected to the busbar via a connector 106, which is mounted to the printed circuit board. Attachment to the printed circuit board provides both a mechanical connection and an electrical connection between the connector and the printed circuit board.

The connector has conductive elements 108 with mating portions 110 that, when the printed circuit board is properly positioned with respect to the busbars, make electrical connections to the busbars. In this example, contact tails 112 from conductive elements inside a connector housing 114 extend into the printed circuit board. Within the printed circuit board, those contact tails are coupled to power planes. Power can be coupled from the busbars, through the connector, to the power planes within the printed circuit boards. Electronic components on the daughtercard also connect to the power planes. In this way, power is distributed from the busbars to components mounted on the daughtercard.

Figure 1B:
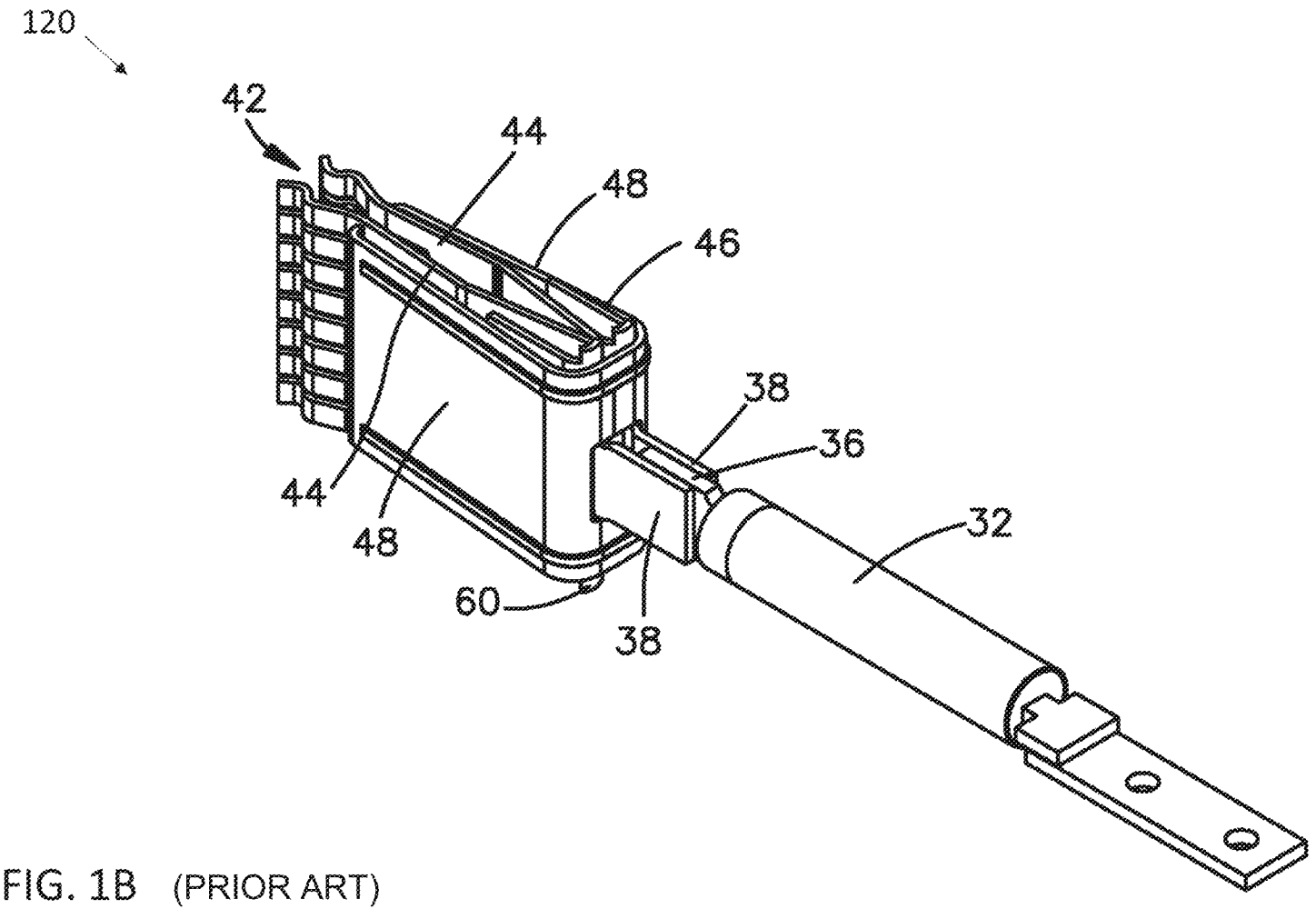
FIG. 1B (PRIOR ART)
FIG. 1B is a perspective view of a power interconnect of an electronic system, with a power connector terminating a power cable.

Other connector configurations may also be used to distribute power from the busbars. FIG. 1B provides an example of a conventional power connector 120 in which power is distributed from the connector attached to the busbars to electronic components that consume the power via a cable. In this example, tabs 38, extending from the conductive elements 44 inside the connector housing 48, provide a point of attachment for power cables 32. Those power cables may be routed to other components on a daughtercard or elsewhere in an electronic system. Alternatively or additionally, such a configuration can be used to supply power to the busbars.

As an example of a further variation, projections 60 from the connector housing may be attached to busbars on the daughtercard. The daughtercard busbars may, like the backplane busbars, be substantially thicker than a powerplane in a printed circuit board, and may present lower resistance and pose a lower risk of voltage-induced failure than powerplanes in a printed circuit board. The daughtercard busbars may be routed over the surface of the daughtercard. Components drawing power may connect directly to the daughtercard busbars or indirectly through cables or using other mechanisms. It should be appreciated that a connector mating interface may be used in a connector adapted to distribute power though a powerplane in a printed circuit board, through a cable, through a daughterboard busbar, or in any other suitable way.

Conventional components of an electronic system are not expressly pictured in FIGS. 1A and 1B, but one of skill in the art will understand that such components may be present. For example, the printed circuit board may contain signal connectors, as in a conventional daughtercard, which mate to signal connectors on a backplane when the printed circuit board is inserted into the system. As another example, the illustrated components may be contained within an enclosure. Further, a power supply or external source of power may be present to supply power to the busbars. As yet another example, though only one printed circuit board is shown, multiple such printed circuit boards may be inserted into the rack. Often the printed circuit boards are mounted in parallel.

As another example, an electronic system may contain rails or other mechanical support structure for the printed circuit board. That mechanical support may enable the printed circuit to be inserted into the system, as with a conventional daughtercard. Those rails position the printed circuit board such that connector engages the busbars. It should be appreciated that any one or more of the connector design features described herein may be used with one or more conventional components.

In the embodiment illustrated in FIGS. 1A and 1B, the connector has mating contact portions within a housing. The mating contact portions are positioned on opposite sides of the busbar. The mating contact portions have compliance such that the connector need not be precisely in its intended nominal position with respect to the busbars to make a proper electrical connection. Rather, the amount of compliance sets a tolerance for mis-alignment of the connector. If the connector and busbars are misaligned by less than this compliance, the connector will mate with the busbar. While such a design is suitable for many applications, the inventors have recognized techniques to increase that tolerance and provide a connector that is suitable for even more applications.

Figure 2:
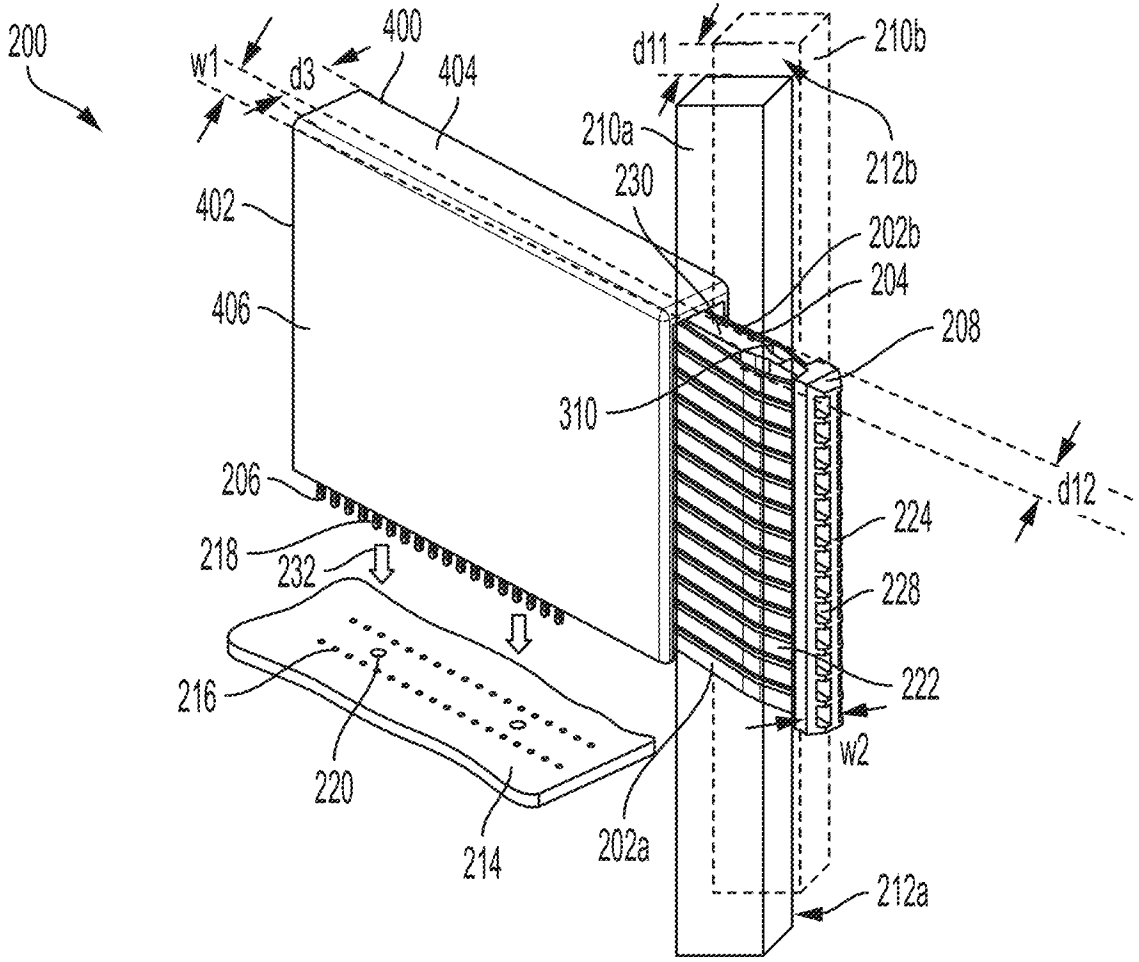
FIG. 2 is a perspective view of a power interconnect of an electronic system, according to some embodiments.

FIG. 2 is a perspective view of an electronic system 200, according to some embodiments. The electronic system may include a connector 400, busbars, here shown as a pair of busbars 210*a* and 210*b*, and a printed circuit board (PCB) 214. The connector may be electrically coupled to the pair of busbars and the PCB such that power can be distributed within the system, for example, from the pair of busbars to components attached to the PCB.

In some embodiments, the pair of busbars 210*a* and 210*b* may include a first busbar 210*a* and a second busbar 210*b*. The pair of busbars may be elongated in parallel in a first direction. The first busbar 210*a* may have a surface 212*a* facing a second surface 212*b* of the second busbar 210*b*. The first and second surfaces 212*a* and 212*b* may be spaced from each other by a distance d11 in a second direction perpendicular to the first direction. In the illustrated example, the pair of busbars are shown as semi-transparent to allow a view of a portion of the connector 400. It should be appreciated that the pair of busbars may be metal or made of other solid materials.

In some embodiments, the PCB 214 may be in a plane substantially perpendicular to the first direction, and may be made using conventional PCB manufacturing techniques such that layers patterned with signal traces and layers of metal, separated by layers of epoxy or other dielectric are distributed throughout the printed circuit board. The PCB may include mechanisms to establish electrical and mechanical connections to connector 400. In the illustrated embodiments, vias 216 and holes 220 perform these functions. As FIG. 2 shows a power connector, vias 216 may be electrically connected to one or more power planes of the PCB.

In some embodiments, the connector 400 may include a housing 402, a member 208 pivotably mounted to the housing, and a pair of conductive elements 202*a* and 202*b*. The housing may be made of an insulative material and may be formed, for example, by molding a thermoplastic material into a desired shape. The conductive elements may be made from a copper alloy, such as C18080 for example, to provide sufficient compliance and also sufficiently low resistance so as to pass a relatively large amount of current without excessive heating. The conductive elements may be made, for example, by stamping and forming a sheet of metal into the shape illustrated.

Each of the pair of conductive elements may have a mating end 204, a mounting end 206, and a body (not visible in FIG. 2). In the illustrated embodiment, the body is intermediate and connects the mating end and the mounting end. The body of the conductive elements are held by the housing. In the illustrated example, the mounting ends of the conductive elements are press fit, "eye of the needle," contacts that are designed to be pressed into vias 216 in the PCB 214. However, other forms of mounting ends may be used, for example, posts for soldering into holes or leads for surface mount soldering.

The housing 402 may also include features for attaching the connector to a PCB 214. In the embodiment illustrated, the mounting features may be posts 218, which may mate with holes 220 on the PCB 214. In some embodiments, the posts 218 and holes 220 may be sized to provide an interference fit such that connector 400 is secured to the PCB 214. In some embodiments, the posts 218 and holes 220 may be included as alignments features to ensure mounting ends 206 of conductive elements 202*a*, 202*b* are aligned with corresponding vias 216 on the PCB 214.

The mating ends of the conductive elements may be configured to fit between the pair of busbars 210*a*, 210*b* and make electrical contacts with the pair of busbars through, for example, the first and second surfaces 212*a* and 212*b*. In the illustrated example, the connector 400 has a pair of conductive elements 202*a* and 202*b*. However, it should be appreciated that the connector may have one conductive element, or three, or more.

In some embodiments, the mating end of each of the pair of conductive elements 202*a*, 202*b* may include a plurality of beams 222. The plurality of beams may be configured to ensure proper mating force and contact resistance between a respective conductive element and a respective surface. Each of the plurality of beams may act independently and adjust to variations in alignment such that a proper contact resistance may be obtained. Each of the plurality of beams may have a bump 310. The bumps of conductive element 202*a* may curve away from conductive element 202*b*. Similarly, the bumps of conductive element 202*b* may curve away from conductive element 202*a*. In some embodiments, conductive element 202*b* may be a mirror image of conductive element 202*a*. The bumps of conductive element 202*a* may be spaced from conductive element 202*b* by a distance d12. The distance d12 may be designed to ensure proper mating force and contact resistance. In some embodiments, the distance d12 may be greater than the distance d11 between the pair of busbars 210*a*, 210*b*. During the process of inserting the mating ends of the conductive elements between the pair of busbars, the bumps of conductive element 202*a* may be pressed towards conductive element 202*b* by surface 212*a*, and the bumps of conductive element 202*b* may be pressed towards conductive element 202*a* by surface 212*b*.

Such a configuration may be created, for example, by preloading the beams 222. Preloading may be achieved, for example, by forming the beams such that, in the free state, they would be separated at their tips by a distance greater than the amount of separation shown in FIG. 2. Their tips, however, may be held in the position illustrated. In the illustrated embodiment, the tips of the beams are held by member 208.

In some embodiments, the first and second conductive elements 202*a* and 202*b* may be separated by the member 208. Member 108, like housing 402, may be formed of insulative material such as plastic, but may alternatively or additionally be formed with a conductive material where insulation is not desired. The member 208 may include a frontend 224 and a body 230. The body may have a first width w1. The first width w1 may be less than the distance d11 between the pair of busbars 210*a*, 210*b* such that the mating ends 204 of the pair of conductive elements 202*a*, 202*b* separated by the body of the member may fit between the pair of busbars. The frontend may have a second width w2. The second width w2 may be greater than the distance d11 in order to prevent undesired disconnection of the connector 400 from the pair of busbars. The frontend may have a plurality of holes 228. The plurality of holes may retain the tips of the beams in the position illustrated, which is closer together than in their free states. Each of the plurality of holes may be sized and positioned to a corresponding beam of a conductive element.

Such a configuration of mating ends of the conductive elements may provide tolerance for misalignment between the connector and the busbars. A system may be designed so that the connector is positioned with member 208 centered at a nominal position that is midway between the inwardly facing surfaces of the busbars. The mating ends, here shaped as a plurality of beams, exhibit compliance such that, when the components are in their mating positions the beams are deflected, generating suitable spring force against the busbars. Tolerance is provided in that the beams, when not deflected are set off from member 208 by a distance that provides travel. The beams may be shaped and positioned such that, when all components of the system are manufactured according to their nominal designs, the beams will be deflected by a portion of this travel. As an example, the nominal designs may be based on the beams being deflected by about half the travel distance. If components deviate from their nominal design, the beams may deflect more or less than the nominal amount, the beams will be either closer or further from member 208, but so long as the deviation is less than half the travel distance, the beams on each side of member 208 will contact a busbar. This amount by which the components can deviate from the nominal position and still mate defines a tolerance associated with the compliant nature of the beams at the mating ends of the conductive elements.

In some embodiments, a greater degree of tolerance may be desired. Such a configuration may enable a connector to provide suitable, low resistance connections to busbars, even if the connector is out of alignment with respect to the busbars by a greater amount than can be compensated for compliant beams. In some embodiments, greater amount of tolerance is provided because the conductive elements are held by the housing such that the body portions and mounting ends are fixed with respect to the housing but the mating ends may pivot with respect to the housing. A pivotable attachment of the mating ends may be provided in any suitable way.

In some embodiments, the housing 402 may include a ceiling 404 and a pair of walls 406 that extends from the ceiling. The pair of walls may be spaced from each other by a wall-to-wall distance d3. The wall-to-wall distance d3 may be greater than the first width w1 of the member 208 and a pivotable mount may fit between the pair of walls.

In some embodiments, to operate the connector 400, the mounting ends 206 of the conductive elements 202*a* and 202*b* may move in a mounting direction 232 and engage with the PCB 214. Subsequently, the member 208 may pivot such that the pair of conductive elements 202*a* and 202*b* fit between the pair of busbars and establish electrical contacts with the pair of busbars.

Alternatively, in some embodiments, to operate the connector 400, the mating ends of the conductive elements 202*a*, 202*b* may be inserted between the pair of busbars 210*a*, 210*b*. Subsequently, the member 208 may pivot such that the mounting ends 206 of the conductive elements may fit in the vias 216 on the PCB 214. In some embodiments, the member 208 may pivot such that posts 218 may fit in holes 220, which ensures the mounting ends of the conductive elements fit in the vias 216 on the PCB 214.

In the illustrated example, the pair of busbars 210*a* and 210*b* elongate in parallel in the first direction perpendicular to the plane in which the PCB 214 lies. The pair of busbars are spaced from each other in the second direction perpendicular to the first direction. The mounting ends 206 of the pair of conductive elements 202*a*, 202*b* extend in the first direction. The mating ends 204 of the pair of conductive elements extend in a third direction perpendicular to the first and second direction. However, due to manufacture variations and other reasons that will be appreciated by a person of ordinary skill in the art, the first direction may not be perfectly perpendicular to the plane, and/or the second direction may not be perfectly perpendicular to the first direction, and/or the third direction may not be perfectly perpendicular to the first and second directions, which are all potential misalignment sources of the system 200. The member 208 may enable the mating ends of the conductive elements to pivot during operation and thus allow a greater tolerance for potential misalignments in the system.

Figure 3:
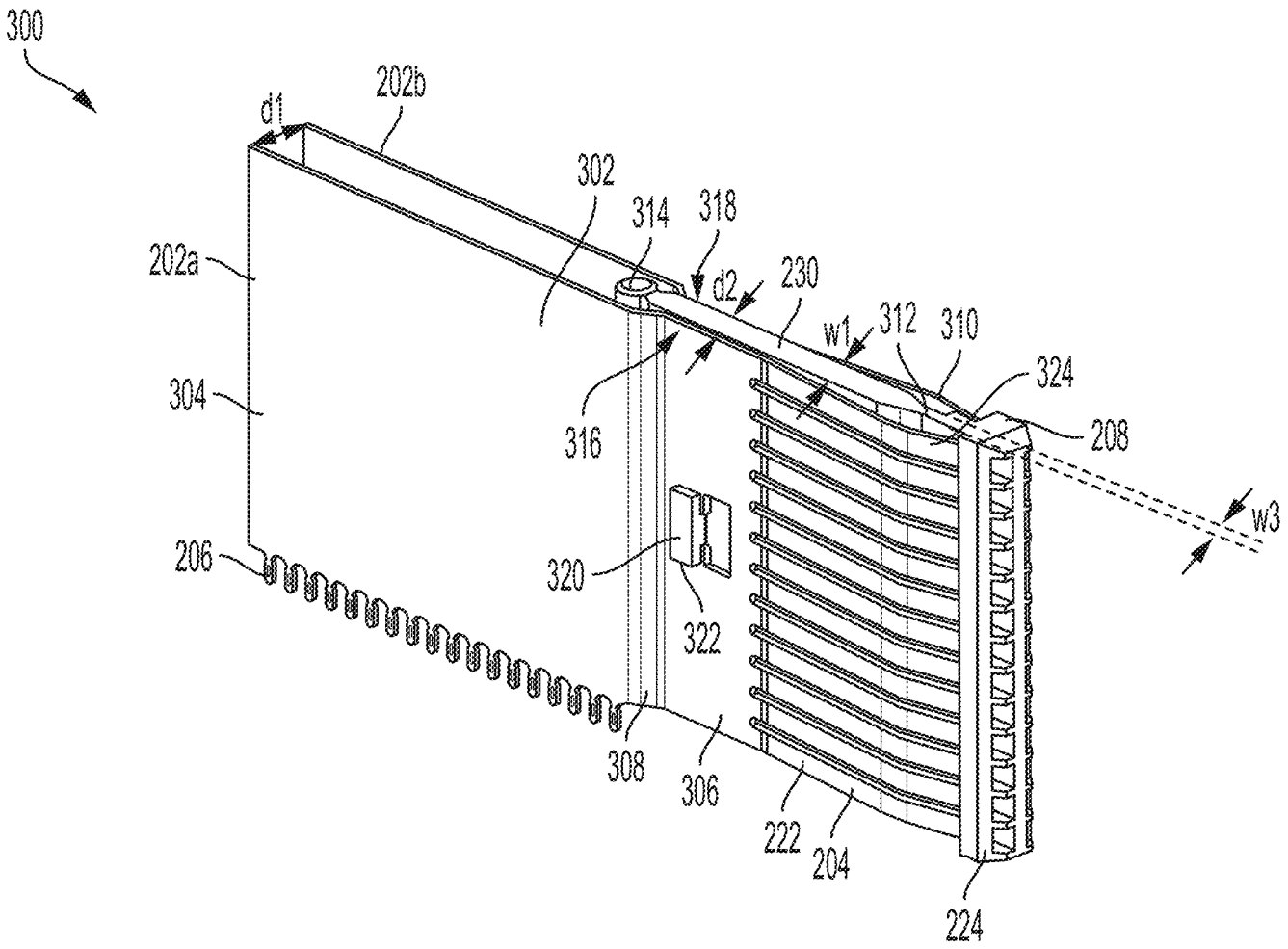
FIG. 3 is a perspective view of a connector subassembly including a pair of conductive elements assembled to a member capable of pivoting, according to some embodiments.

FIG. 3 is a perspective view of a connector subassembly 300 including a pair of conductive elements 202*a* and 202*b* assembled to a member 208 capable of pivoting, according to some embodiments. In the illustrated embodiment, connector 400 may be manufactured by first attaching conductive elements 202*a* and 202*b* to member 208 and then inserting portions of the assembly into housing 402.

In some embodiments, the pair of conductive elements may include a first conductive element 202*a* and a second conductive element 202*b*. Each of the first and second conductive elements may have a mating end 204, a mounting end 206 opposite the mating end, and an intermediate portion 302 connecting the mating end 204 and the mounting end 206. Here the mating end is opposite the mounting end in the sense of a current flow path through the conductive element. The mating end, in this example, is physically along an edge of the conductive element that is perpendicular to an edge forming the mounting end. However, it should be appreciated that, in some embodiments, it may be desired for the mating end and mounting ends to be along edges that are physically opposite each other. The intermediate portion may include a first part 304, a second part 306, and a transition part 308 connecting the first part and the second part.

In some embodiments, the mating end 204 may include a plurality of beams 222 capable of flexing. Each of the plurality of beams may include a bump 310. Each beam may flex independently from each other such that each beam makes contact with a mating busbar even if there are misalignments between the conductive elements and the mating busbar. Configuring the mating end into beams ensures proper mating force, provides lower contact resistance, allows reliable mating to misaligned busbar, and provides low insertion/extraction forces. In some embodiments, an offset between a conductive element and a mating busbar may be up to 5 mm, 3 mm, 2 mm, or 1 mm.

In some embodiments, the pair of conductive elements may be made of copper alloy. An example of a suitable alloy is Cu Alloy C18090, Temper R520, but other materials may provide a suitably low resistance and mechanical flexibility. Some areas of each conductive element, such as the contact regions, which here are the concave outer surfaces of bumps 310, may be plated with silver-based plating (AGT) to further reduce the contact resistance and eliminate fretting corrosion found in tin-plated connectors. An exemplary silver-based plating (AGT) is described in U.S. Pat. No. 9,627,790 and U.S. Pre-grant Publication 2017/01491517, which are hereby incorporated by reference in their entirety.

In some embodiments, the member 208 may include a frontend 224, a backend 314, a body 230, and a region 312 connecting the body and the frontend. The backend may be configured to provide a pivotable mount with respect to other components of connector 400, such as housing 402 or bushings inserted into housing 402. In the illustrated example, backend 314 is semi-cylindrical. Here, backend 314, except for the portions that are integral with the rest of member 308, are cylindrical. In this configuration, backend 314 may serve as a shaft around which member 208 may pivot. However, backend 314 may have any suitable shape.

The body may have a first width w1, greater than a third width w3 of the region 312. The member 208 may be made of any suitable insulative material. In some embodiments, the member may be made of a thermoplastic material, which may be filled with glass fibers or other fillers. An example of a suitable material is ZYTEL HTN RF52G45NHF sold by DuPont Performance Plastics. As a result, the first and second conductive elements 202*a* and 202*b* are electrically isolated from one another within connector 400. The isolation may resist arcing and breakdown at 200V and in some embodiments at 400V, or higher such that they may be used as two poles, carrying voltages at different levels if desired.

In some embodiments, the first conductive element 202*a* may be attached to a first side 316 of the member 208. The second conductive element 202*b* may be attached to a second side 318 of the member. In some embodiments, the member 208 and the pair of conductive elements may have matching features 320 and 322 to ensure secured and aligned attachments. In some embodiments, the region 312 may be sized and positioned corresponding to the bumps 310 of the beams 222 such that the bumps may deform when there is pressure generated by, for example, inserting the mating portions between surfaces of busbars. In the embodiment illustrated, features 320 and 322 secure the rears of the mating portions of conductive elements against a surface of member 208. The forward portions of the mating portions are held within holes 228, but may slide with respect to the surfaces of member 208 as member 208 pivots or as the beams forming the forward portions of the mating portions are compressed during mating to busbars.

In the illustrated connector subassembly 300, the mounting ends 306 of the first and second conductive elements 202*a* and 202*b* are spaced from each other substantially by a first distance d1. The rear portions of the mating ends 204 of the first and second conductive elements are spaced from each other substantially by a second distance d2. In some embodiments, the first distance d1 may be greater than the second distance d2. In some embodiments, the first parts 304 of the intermediate portions 302 of the first and second conductive elements may be spaced from each other substantially by the first distance d1. The second parts 306 of the intermediate portions of the first and second conductive elements may be spaced from each other substantially by the second distance d2.

Figure 4:
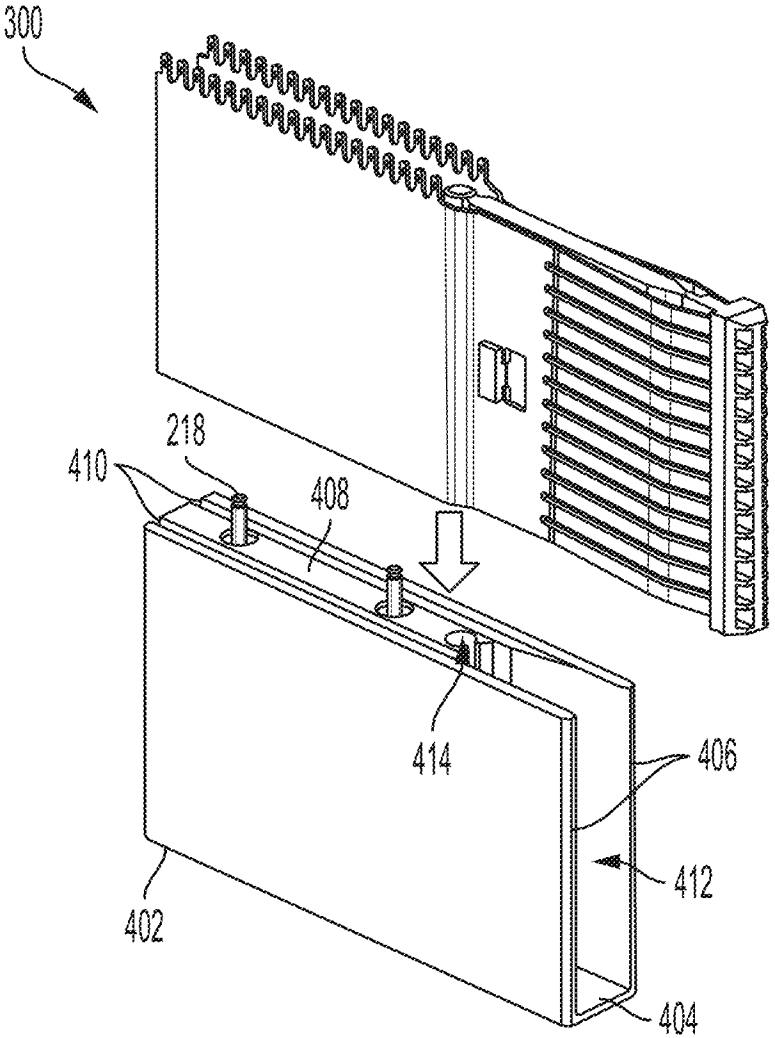
FIG. 4 is a perspective view of a connector during manufacture, showing the connector subassembly of FIG. 3 being loaded into a connector housing, according to some embodiments.

FIG. 4 is a perspective view of the connector subassembly 300 being loaded into a connector housing 402, according to some embodiments. The connector housing may include a ceiling 404, a pair of walls 406 that extends from the ceiling, and a center piece 408. FIG. 4 illustrates housing 402 formed with ceiling 404, walls 406 and center piece 408 being formed as an integral component, such as by a molding operation. However, it should be appreciated that housing 402 may be formed as two or more separate components that are held together in any suitable way.

Center piece 408 may be sized and positioned such that slots 410 may be formed to each receive at least a portion of the first and second conductive elements 202*a* and 202*b*. In the illustrated embodiment the intermediate portions of the conductive elements are held within slots 410. Such a configuration may secure the mounting ends of the conductive elements with respect to housing 402 as connector 400 is mounted to a printed circuit board. Thus, portions of the conductive elements may be fixed with respect to housing 402 even as the mating portions of the conductive elements pivot. However, any suitable attachment may be used.

Center piece 408 may have a portion shaped to engage with the backend 314 of member 208 so as to provide a pivotable mounting of member 208. That portion of center piece 408 may have a shape complementary to that of backend 314. In an embodiment in which backed 314 is semi-cylindrical, center piece 408 may have an opening shaped to receive the cylindrical portion of backend 314 such that cylindrical portion rotates within the opening. Opening 414 is illustrated for this purpose. Here, opening 414 is semi-circular, being circular and bounded by the material forming center piece 408 over more than 50% of the perimeter of a circle such that, when the semi-cylindrical portions of backend 314 are inserted into opening 414, member 208 is restrained from being removed from housing 402 in a direction parallel to the elongated direction of the beams forming the mating contacts or from translating in a direction perpendicular to the intermediate portions of the conductive elements. Opening 414 is, however, open over a portion of its perimeter. This open portion enables member 208 to extend from opening 414 and to pivot with respect to housing 402. In some embodiments, opening 414 and the backend 314 are shaped to enable rotation of member 208 around an axis in the elongated direction of opening 414 over an angular extent. That angular extent may be at least 1 degree and in some embodiments may be at least +/−5 degrees, or at least +/−10 degrees or at least +/−15 degrees, and in some embodiments between +/−1 and 30 degrees.

Housing 402 may be shaped to enable such rotation. Housing 402, for example, may have an opening in which portions of member 208 are disposed that is larger than the member, alone. Such an opening 412 may be formed to receive at least a portion of the first and second conductive elements and at least a portion of the member 208. The center piece may also include posts 218 or other features for mechanical attachment to a printed circuit board.

Figure 5:
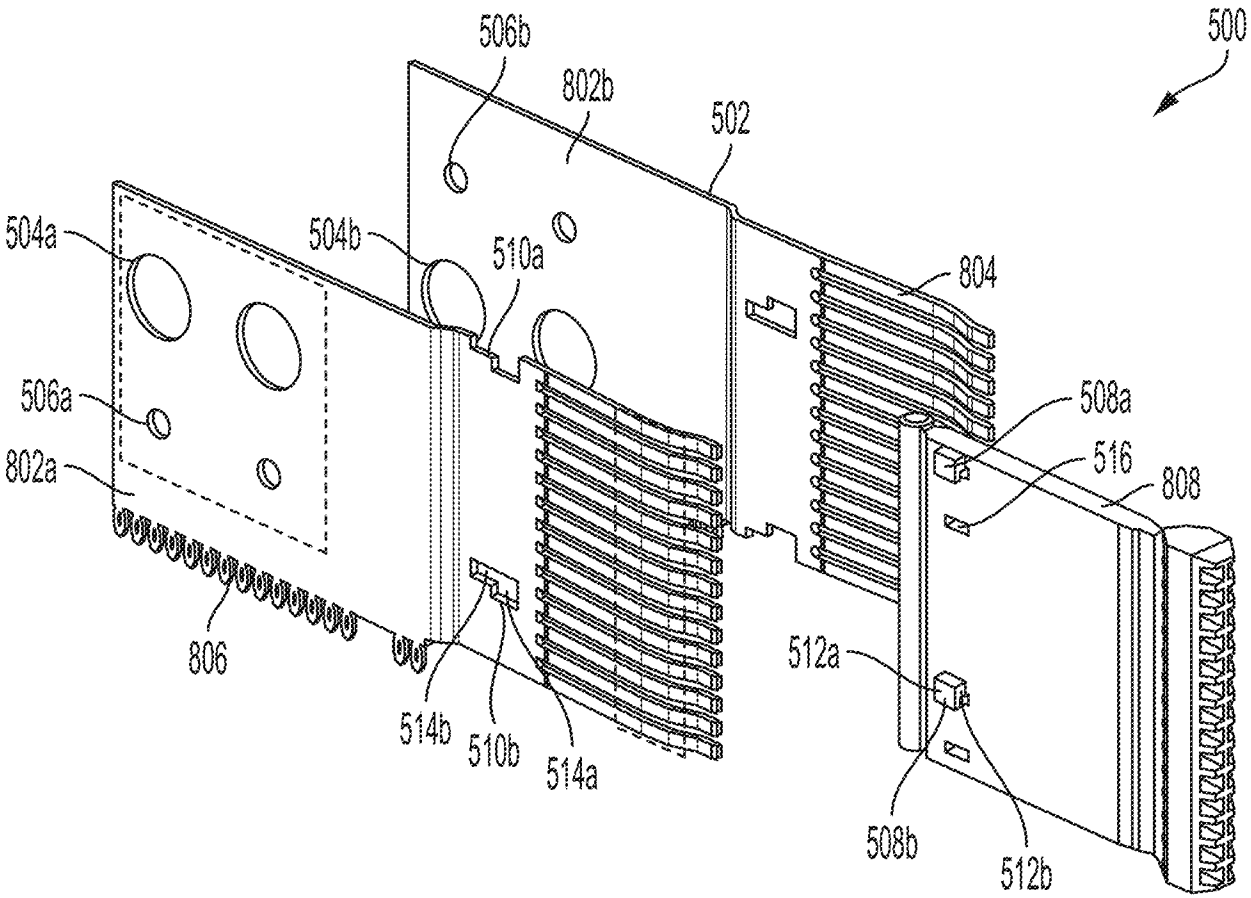
FIG. 5 is an exploded perspective view of a connector subassembly, according to some embodiments.

FIG. 5 is an exploded perspective view of a connector subassembly 500, according to some embodiments. The connector subassembly 500 may include a pair of conductive elements 802*a* and 802*b* and a pivoting member 808. Each of the pair of conductive elements may have a mating end 804, a mounting end 806, and an intermediate body 502 that extends between the mating end and the mounting end. The intermediate body 502 of the first conductive element 802*a* may include first holes 504*a* and second holes 506*a*. First holes 504*a* are sized to receive a bearing sleeve (e.g., a bearing sleeve 812 illustrated in FIG. 7). Second holes 506*a* are smaller, and are sized to receive a bolt (e.g., a bolt 904 illustrated in FIG. 9B). Similar sized holes are included in the second conductive element 802*b*, except that first holes 504*b* align (in a direction perpendicular to the mating direction of the connector) with second holes 506*a*.

First and second conductive elements 802*a* and 802*b* may be designed to attach to opposite sides of member 808. In the illustrated example, first conductive element 502*a* has two first holes 504*a* aligned in a first line and two second holes 506*a* aligned in a second line that is substantially parallel to the first line and closer to the mounting end 806 of first conductive element 802*a*. Second conductive element 802*b* has two first holes 504*b* aligned in a third line and two second holes 506*b* in a fourth line that is substantially parallel to the third line and farther away from the mounting end 806 of second conductive element 802*b*.

FIG. 5 illustrates an alternative embodiment of attachment mechanism for attaching conductive elements to a pivotal member. Here, two attachment mechanisms 508*a*, 508*b* are included on each surface of pivoting member 808, but any suitable number of attachment features may be used. As can be seen, the pivoting member has an attachment feature 516 that is smaller closer to the surface of pivoting member 808 than the two attachment mechanisms 508*a*, 508*b*. In the illustrated embodiment, the attachment features 508*a*, 508*b* are L-shaped. The corresponding conductive element has a keyed opening, for example, openings 510*a*, 510*b*, with a larger portion 514*a* and a smaller portion 514*b*. Such a configuration enables the larger portion 514*a* of the attachment feature 508*b* to be inserted through the larger portion of the opening and then the parts may be slid relative to each other such that the smaller portion 512*b* of the attachment feature 508*b* is positioned in the smaller portion 514*b* of the opening 510*b*, with the conductive element 802*a* trapped between the larger portion 512*a* of the attachment feature 508*b* and the surface of the pivoting member 808. In the embodiment illustrated in FIG. 5, a forward portion of the opening is large enough to receive the base of the L-shaped feature.

Figure 6:
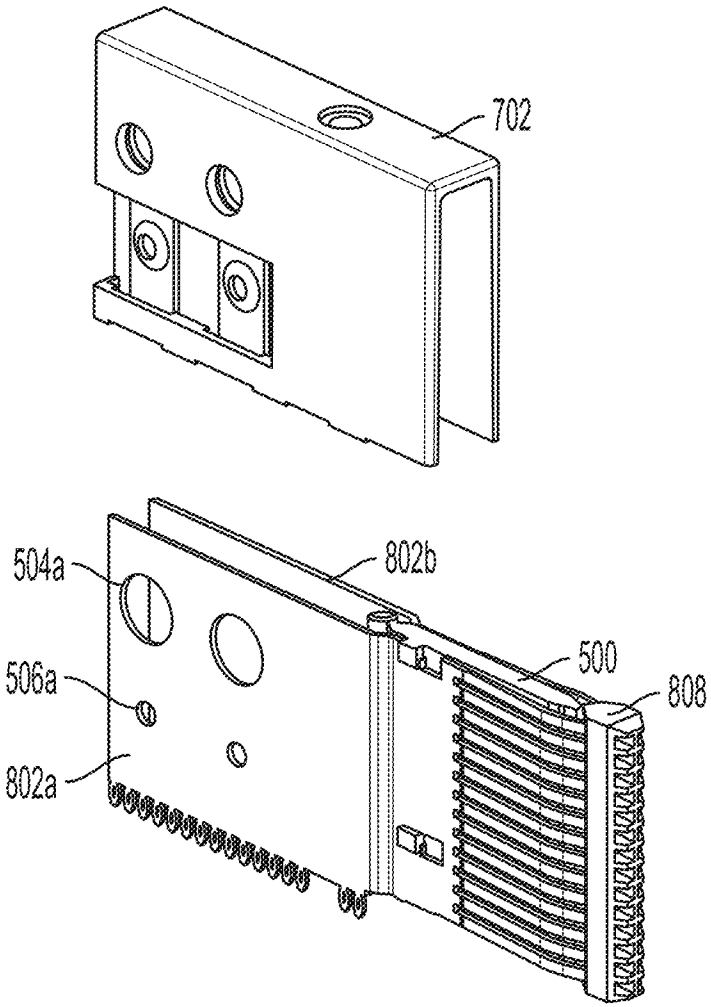
FIG. 6 is a perspective view, showing attaching a connector housing to the connector subassembly of FIG. 5, according to some embodiments.

FIG. 6 is a perspective view, showing attaching a housing 702 to the connector subassembly 500, according to some embodiments. FIG. 6 shows the conductive elements slid relative to pivoting member 808 such that the conductive elements are held against the surface of the pivoting member 808.

Figure 7:
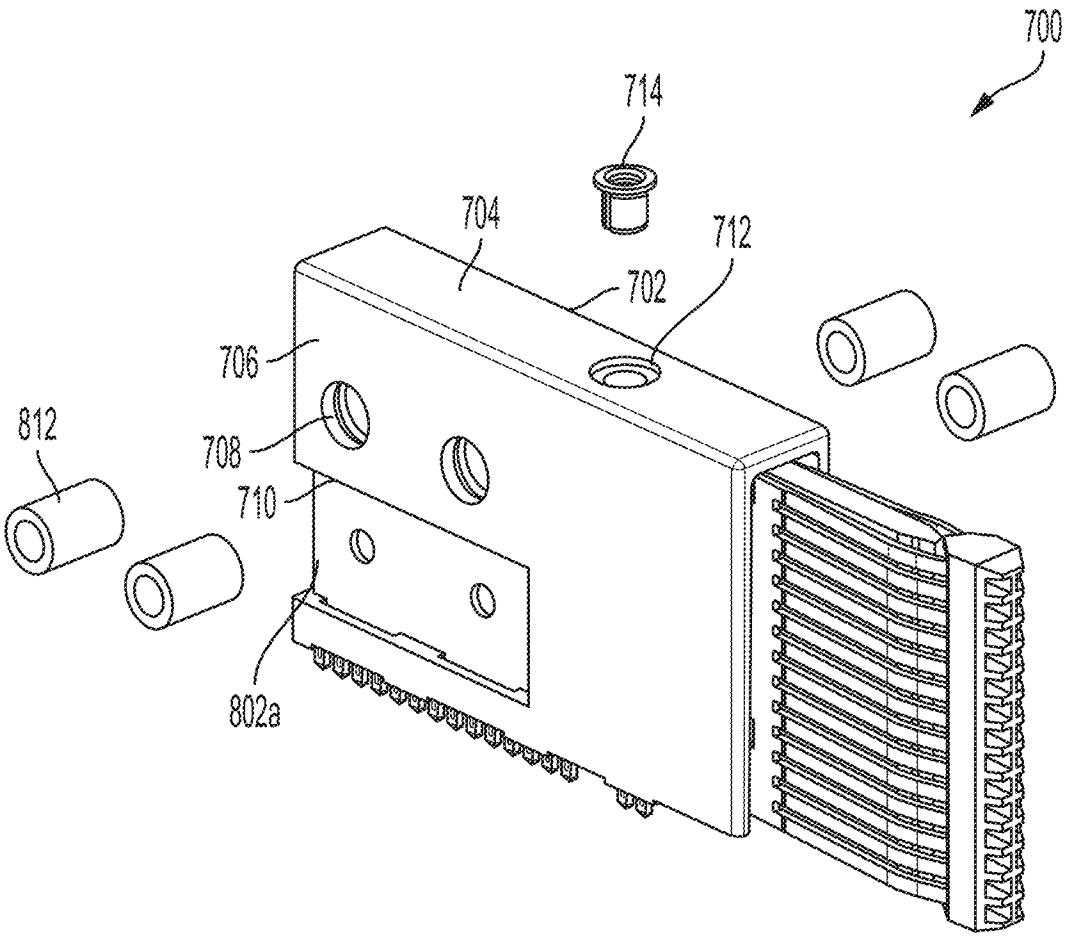
FIG. 7 is a partially exploded perspective view of a connector, according to some embodiments.

FIG. 7 is a partially exploded perspective view of a connector 700, according to some embodiments. The connector 700 may include the connector subassembly 500 attached in the housing 702. The housing 702 may include a ceiling 704 and walls 706 that extends from the ceiling. The ceiling may include a hole 712 to receive a threaded insert 714. In some embodiments, the threaded insert may be made of brass.

A wall 706 may include third holes 708 and an opening 710. In some embodiments, third holes 708 may be sized and positioned corresponding to first holes 504*a* or 504*b* of the conductive elements such that bearing sleeves 812 may be inserted. However, in some embodiments, the holes 708 may be smaller than corresponding holes 504*a* or 504*b* to ensure that the sleeves, when inserted through the housing pass through the corresponding hole 504*a* or 504*b* without making contact with the corresponding conductive element. In some embodiments, the bearing sleeves may be made of stainless steel (seamless tubing, ¼" O.D.).

In the illustrated example, a portion of conductive element 802*a* is exposed by opening 710. The opening 710 may be positioned and sized to receive a portion of an extension element (e.g., an extension element 902 illustrated in FIGS. 9A & 9B) such that the extension element is in contact with the exposed portion of the conductive element. That extension element may provide an attachment location for a cable or may be or provide an attachment location for a daughtercard busbar or some other power distribution member.

Figure 8:
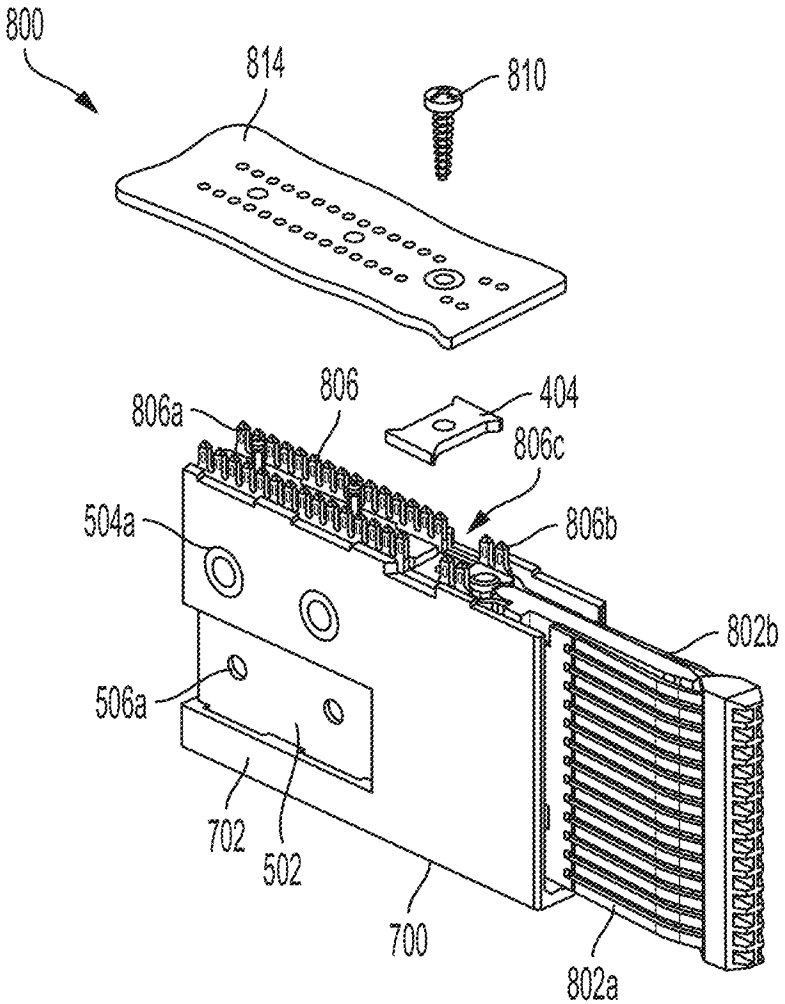
FIG. 8 is a partially exploded perspective view of the connector of FIG. 7 in a configuration for mounting to a printed circuit board.

FIG. 8 is a partially exploded perspective view of a connector 700 in a configuration for mounting to a printed circuit board (PCB) 814. Electronic system 800 illustrates a connector 700 that may perform the functions described above for connector 400, and illustrates features that may be used instead of or in addition to the features described above. The electronic system may include a connector 700, a printed circuit board (PCB) 814, and a tie-bar 404. The tie-bar may be secured to the connector by same fastener 810 that secures the connector to the PCB. In the embodiment illustrated, tie-bar 404 has flared ends that fit in corresponding flares in the walls of housing 702. Tightening fastener 810 forces the flared ends of tie-bar 404 into the flared openings in the walls, preventing the walls from spreading further apart than the ends of the tie-bar. Here, tie-bar 404 is an insulative member that retains the conductive elements in a slot in housing 702. In other embodiments, retention member 404 may be metal or other conductive material. Such a configuration may be useful if the conductive elements of the connector are to be tied to a common potential.

As shown, the connector 700 may include a housing 702 and a pair of conductive elements 802*a* and 802*b* held by the housing. Each of the pair of conductive elements may have a mating end 804, a mounting end 806, and an intermediate body 502 that extends between the mating end and the mounting end. The mounting end may include a first portion 806*a* and a second portion 806*b* separated by a space 806*c*. In some embodiments, the space may be positioned and sized to receive the tie-bar 404.

Connector 700 is, in the illustrated embodiment, configured to distribute power through components attached to the connector instead of or in addition to through power planes in a printed circuit board to which contact tails of the conductive elements are attached. Those alternative distribution mechanisms may include a cable and/or a daughtercard busbar. In the embodiment illustrated, the housing 702 is shaped to expose portions of the conductive elements so as to enable mechanical and therefore electrical contact between the conductive elements and the alternative distribution mechanism. Housing 702 has an opening that exposes intermediate body 502 of conductive element 802*a*. A similar opening in the opposite side of the housing may expose an intermediate body of conductive element 802*b*. Connector 700 may be configured such that a distribution mechanism may be positioned parallel to the exposed portion of the intermediate body and then bolted to connector 700. The intermediate body 502 may include first holes 504*a* and second holes 506*a*. First holes 504*a* are sized to receive a bearing sleeve 812. Second holes 506*a* are smaller, but are sized to receive a bolt 904. Similar sized holes are included in the second conductive element, except that first holes 504*b* align (in a direction perpendicular to the mating direction of the connector) with second holes 506*a*. Housing 702 may have holes of corresponding dimensions, such that a sleeve 812 may be inserted through the second conductive element and contact the first conductive element around hole 506*a*, ensuring that tightening a nut 910 around such a bolt 904 with apply pressure to a surface of the first conductive element, however, sleeve 512 will retain the dimension of the connector. A nut 910 and a bolt 904 may be used, for example, to electrically and mechanically attach an extension member 902 (FIGS. 9A and 9B) to each of the conductive elements within the connector.

Figure 9B:
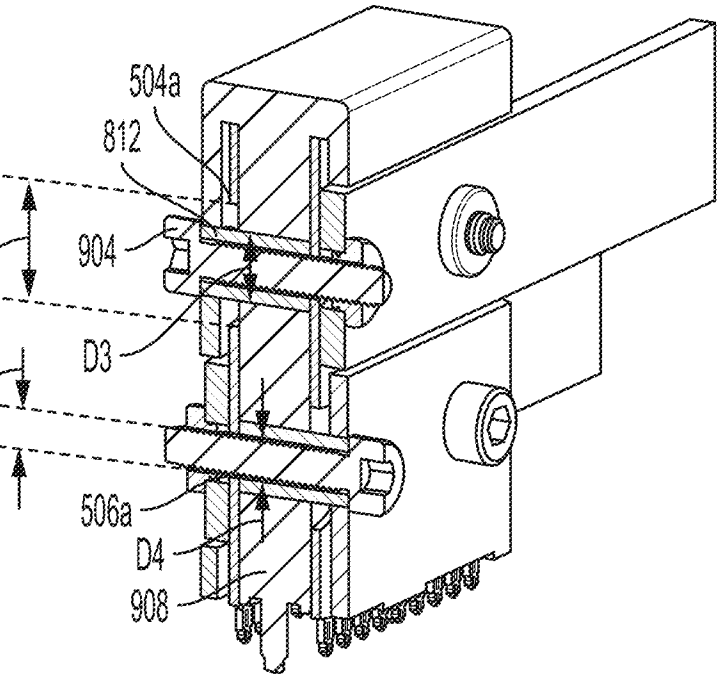
FIG. 9B is a perspective view of the connector of FIG. 9A, with portions cutaway along line 9B.
Figure 9A:
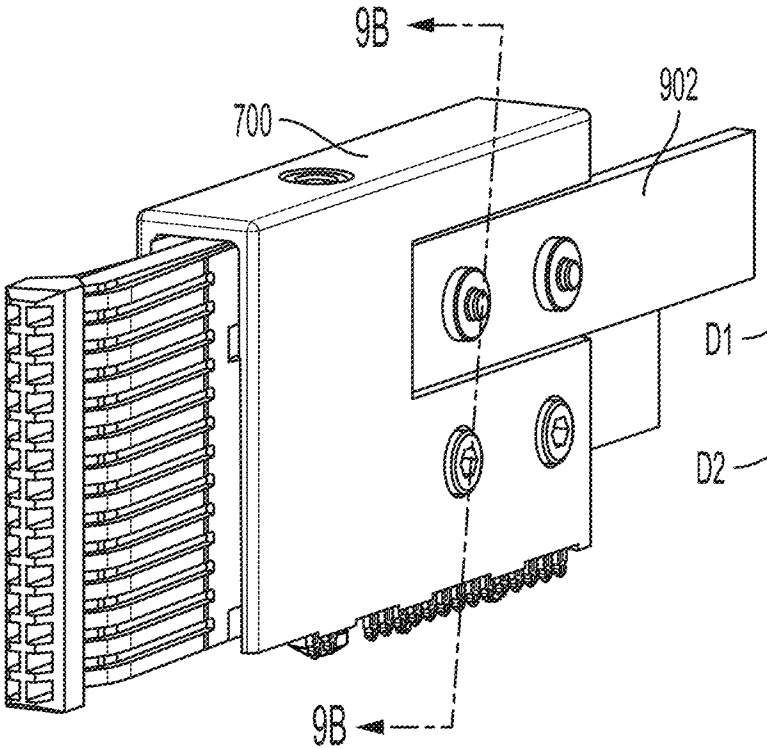
FIG. 9A is a perspective view of the connector of FIG. 7 fully assembled in a configuration for use as a cable termination.

FIG. 9A is a perspective view of connector 700 fully assembled in a configuration for use as a cable termination, with a pair of extension elements 902 attached. FIG. 9B is a perspective view of the connector 700 with portions cutaway along line 9B. First holes 504*a*, 504*b* may have a diameter D1. Second holes 506*a*, 506*b* may have a diameter D2. Bearing sleeves 812 may have a diameter D3. Bolts 904 may have a diameter D4. In the illustrated example, D1 is greater than D3 such that each bearing sleeve is in contact with one of the pair of conductive elements but not the other. D2 is substantially equal to D4 such that appropriate force is provided to secure an extension elements and a conductive element to a center piece 908 of the housing 702.

Although details of specific configurations of power connectors are described above, it should be appreciated that such details are provided solely for purposes of illustration, as the concepts disclosed herein are capable of other manners of implementation. In that respect, various connector features described herein may be used in any suitable combination, as aspects of the present disclosure are not limited to the particular combinations shown in the drawings.

For example, a connector designed to be attached to a printed circuit board was used to illustrate the construction techniques described herein. The same techniques may be used with a connector, also mounted to a printed circuit board, that mates with a connector that is part of a cable assembly. In yet further embodiments, neither a connector with a frame and a housing member as described herein nor a mating connector may be mounted to a printed circuit board.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. For example, busbars are illustrated as having a length along an axis of elongation that is substantially longer than the height of a connector in a direction parallel to the axis of elongation. Such a configuration is common in systems in which, for example, the busbars supply power to multiple daughtercards mated to the same backplane. However, it is not a requirement that the busbars extend the entire length of the backplane or even that the busbars provide power to multiple daughtercards. In some embodiments, the busbars to which a connector as described herein may themselves be within a connector. Those busbars may be electrically coupled to power planes within a printed circuit board, such as a backplane, or may be coupled to a source of power through cables.

As an example of another variation, a connector is described as being configured for distribution of power from busbars to components on one or more daughtercards. It should be appreciated, however, that the direction of power flow is provided for simplicity of explanation. Power might be coupled through the connector to the busbars.

Furthermore, although many inventive aspects are shown and described with reference to a connector having a right angle configuration, it should be appreciated that aspects of the present disclosure is not limited in this regard, as any of the inventive concepts, whether alone or in combination with one or more other inventive concepts, may be used in other types of electrical connectors, such as mezzanine connectors, cable connectors, stacking connectors, I/O connectors, chip sockets, etc.

The present disclosure is not limited to the details of construction or the arrangements of components set forth in the foregoing description and/or the drawings. Various embodiments are provided solely for purposes of illustration, and the concepts described herein are capable of being practiced or carried out in other ways. Also, the phraseology and terminology used herein are for the purpose of description and should not be regarded as limiting. The use of "including," "comprising," "having," "containing," or "involving," and variations thereof herein, is meant to encompass the items listed thereafter (or equivalents thereof) and/or as additional items.

In some embodiments, dimensions or other values are described as being the same or "equal." It should be understood that in practical systems and devices, values that are considered equal are not always mathematically identical as practical components and products will be produced with tolerances. Accordingly, values may be regarded as the same or equal may differ within some tolerance allowable for a given application, which may be within ±20% in some embodiments, within ±10% in some embodiments, within ±5% in some embodiments, and yet within ±2% in some embodiments.

Further, it should be understood that when values are given, they are, unless context specifies otherwise, measured in accordance with an applicable measurement technique known in the art.

What is claimed is:

1. An electrical connector, comprising:

an insulative housing;

an insulative member pivotably mounted to the housing at a pivotable attachment; and a first conductive element, the first conductive element comprising a body and a mating portion extending from the body, wherein:

the body is supported by the housing, and the mating portion is coupled to the insulative member pivotably mounted to the housing such that the mating portion pivots with the insulative member.

2. The electrical connector of claim 1, wherein:

the mating portion of the first conductive element comprises a plurality of beams, and each of the plurality of beams comprises a convex surface facing away from the insulative member.

3. The electrical connector of claim 1, wherein the mating portion of the first conductive element comprises a plurality of beams, and the plurality of beams are configured to carry in excess of 350 A with a temperature rise of no greater than 30° C.

4. The electrical connector of claim 3, wherein a frontend of the member comprises a plurality of holes, and a distal end of each beam of the plurality of beams is disposed within a hole of the plurality of holes.

5. The electrical connector of claim 1, wherein the housing comprises a ceiling and a pair of walls that extend from the ceiling, the pair of walls being separated from each other by a wall-to-wall distance, the wall-to-wall distance being greater than a width of the member.

6. The electrical connector of claim 5, wherein:

the housing comprises a center piece between the pair of walls, a first slot between the center piece and a first wall of the pair of walls and a second slot between the center piece and a second wall of the pair of walls;

a portion of the first conductive element is disposed within the first slot;

a portion of the second conductive element is disposed within the second slot;

the center piece comprises an opening; and a portion of the member is disposed within the opening.

7. The electrical connector of claim 6, wherein the opening of the center piece is semi-cylindrical, and the portion of the member is semi-cylindrical such that the member is pivotable with respect to the center piece.

8. The electrical connector of claim 5, further comprising a bushing inserted in the housing and a portion of the member is pivotally retained within the bushing.

9. An electrical connector, comprising:

a housing;

a member pivotably mounted to the housing;

a pair of conductive elements, each of the pair of conductive elements comprising a mating end and a mounting end opposite the mating end, and an intermediate portion in the housing, the intermediate portion connecting the mating end and the mounting end; and wherein the mating ends of the conductive elements of the pair of conductive elements are separated by the member.

10. The electrical connector of claim 9, wherein the mounting ends of the pair of conductive elements are spaced from each other substantially by a first distance, the mating ends of the pair of conductive elements are spaced from each other substantially by a second distance, and the first distance is greater than the second distance.

11. The electrical connector of claim 10, wherein:

the intermediate portion of each of the pair of conductive elements comprises a first part, a second part, and a transition part that extends between the first and second part;

the first parts of the pair of conductive elements are spaced from each other substantially by the first distance; and the second parts of the pair of conductive elements are spaced from each other substantially by the second distance.

12. The electrical connector of claim 9, wherein:

the member comprises a frontend, a backend, and a body that extends between the frontend and the backend, the body having a first width; and the backend is pivotably coupled to the housing such that the member pivots with respect to the housing about an axis through the backend.

13. The electrical connector of claim 12, wherein the backend is semi-cylindrical.

14. The electrical connector of claim 12, wherein:

the body of the member comprises a first surface and a second surface, opposite the first surface;

the first surface comprises a first projection and the second surface comprises a second projection;

the mating end of a first conductive element of the pair of conductive elements comprises a first opening receiving the first projection so as to hold the first conductive element adjacent the first surface; and the mating end of a second conductive element of the pair of conductive elements comprises a second opening receiving the second projection so as to hold the second conductive element adjacent the second surface.

15. The electrical connector of claim 12, wherein the frontend of the member has a second width, the second width being greater than the first width.

16. The electrical connector of claim 14, wherein:

the mating ends of the conductive elements of the pair of conductive elements comprise a plurality of beams;

the frontend of the member comprises a first plurality of holes adjacent the first surface and a second plurality of holes adjacent the second surface; and distal tips of the plurality of beams of the first conductive element are disposed within the first plurality of holes and distal tips of the plurality of beams of the second conductive element are disposed within the second plurality of holes.

17. The electrical connector of claim 9, wherein the pair of conductive elements and the member have complementary features such that the pair of conductive elements are attached to opposite sides of the member.

18. An electronic system, comprising:

a printed circuit board;

first and second busbars elongated in parallel, wherein the first busbar has a first surface facing a second surface of the second busbar; and a connector comprising:

a housing, a pivotable member pivotably mounted to the housing, and first and second conductive elements each comprising a mating end, a mounting end opposite the mating end, and an intermediate portion, the intermediate portion connecting the mating end and the mounting end, wherein:

the mounting ends of the first and second conductive elements are coupled to the printed circuit board, and the mating ends of the first and second conductive elements are attached to the pivotable member and inserted between the first and second busbars so as to establish electrical connections to the first and second surfaces.

19. The electronic system of claim 18, wherein the mating ends of the of the first and second conductive elements are spring biased against the first and second surfaces.

20. A method of operating a connector mounted to a printed circuit board to make a connection to first and second parallel busbars, wherein:

the first busbar has a first surface facing a second surface of the second busbar, the connector comprises a housing, a member pivotably mounted to the housing, and first and second conductive elements comprising mating ends separated by the member, and the method comprises:

positioning the printed circuit board with respect to the busbars such that a portion of the connector is between the busbars; and pushing the printed circuit board toward the busbars, thereby pivoting the mating ends with respect to the connector housing such that the mating ends fit between first and second busbars and establish an electrical connection between the mating ends of the conductive element and the first and second surfaces.

21. The method of claim 20, wherein:

the portions of the first and second conductive elements attached to the housing are parallel to an axis of elongation of the first and second busbars;

the connector has a first centerline midway between the portion of the first conductive elements attached to the housing and the portion of the second conductive elements attached to the housing;

the busbars have a second centerline midway between the first busbar and the second busbar; and the first centerline is offset from the second centerline in a direction perpendicular to the axis of elongation when an electrical connection between the mating ends of the conductive element and the first and second surfaces is established.

22. The method of claim 21, wherein:

the portions of the first and second conductive elements attached to the housing are separated by a first distance; and the first centerline is offset from the second centerline by a distance exceeding 5% of the first distance.

23. The method of claim 22, wherein the first centerline is offset from the second centerline by a distance exceeding 10% of the first distance.

* * * * *